US005853967A

United States Patent [19]

Dickerson

[11] Patent Number: 5,853,967

[45] Date of Patent: Dec. 29, 1998

[54] RADIOGRAPHIC ELEMENTS FOR MAMMOGRAPHIC MEDICAL DIAGNOSTIC IMAGING

[75] Inventor: Robert E. Dickerson, Hamlin, N.Y.

[73] Assignee: Eastman Kodak Company, Rochester, N.Y.

[21] Appl. No.: 82,952

[22] Filed: May 21, 1998

Related U.S. Application Data

[63] Continuation-in-part of Ser. No. 909,315, Aug. 14, 1997, abandoned.

[51] Int. Cl.[6] ..... G03C 1/005; G03C 5/16; G03C 1/035

[52] U.S. Cl. ..... 430/502; 430/508; 430/509; 430/966; 430/567; 430/513; 430/963; 430/605

[58] Field of Search ..... 430/502, 508, 430/509, 966, 567, 513, 963, 605

[56] References Cited

U.S. PATENT DOCUMENTS

| | | | |
|---|---|---|---|
| 4,710,637 | 12/1987 | Luckey et al. | 250/486.1 |
| 4,803,150 | 2/1989 | Dickerson et al. | 430/502 |
| 4,900,652 | 2/1990 | Dickerson et al. | 430/502 |
| 5,108,881 | 4/1992 | Dickerson et al. | 430/502 |
| 5,449,599 | 9/1995 | Heremans | 430/567 |
| 5,470,700 | 11/1995 | Marui | 430/567 |
| 5,576,156 | 11/1996 | Dickerson | 430/502 |
| 5,639,591 | 6/1997 | Adachi | 430/567 |
| 5,716,774 | 2/1998 | Dickerson et al. | 430/571 |
| 5,759,754 | 6/1998 | Dickerson | 430/502 |

*Primary Examiner*—Mark F. Huff
*Attorney, Agent, or Firm*—Carl O. Thomas

[57] ABSTRACT

A mammographic medical diagnostic radiographic element is disclosed having emulsion layers coated on opposite surfaces of a transparent film support. To facilitate rapid processing the emulsion layers are fully forehardened and less than 35 mg/dm$^2$ of hydrophilic colloid is coated on each major surface. To reduce crossover and hydrophilic colloid, emulsions on the opposite sides of the support are each divided into two layers with the layer coated nearest the support containing a particulate dye capable of being decolorized during processing. Particulate dye and silver halide grains together account for between 30 and 70 percent of the total weight of the emulsion layers. Combined with the use of spectrally sensitized tabular grain emulsions crossover can be reduced to less than 15 percent while processing can be completed in less than 45 seconds. The distribution of hydrophilic colloid and silver halide grains chosen achieves low wet pressure sensitivity. Reducing the coefficient of variation of the radiation-sensitive silver halide grains to less than 15 percent and incorporating a rhodium dopant in a normalized molar concentration of less than $1\times10^{-7}$ based on silver allows average and lower scale contrasts currently used for mammographic imaging to be satisfied without any significant reduction in photographic speed.

8 Claims, No Drawings

RADIOGRAPHIC ELEMENTS FOR MAMMOGRAPHIC MEDICAL DIAGNOSTIC IMAGING

CROSS-REFERENCE TO RELATED APPLICATIONS

This is a continuation-in-part of application Ser. No. 08/909,315, filed Aug. 14, 1997 titled "RADIOGRAPHIC ELEMENTS FOR MAMMOGRAPHIC MEDICAL DIAGNOSTIC IMAGING" by Robert E. Dickerson, now abandoned.

FIELD OF THE INVENTION

The invention relates to radiographic elements containing radiation-sensitive silver halide emulsions adapted to be exposed by a pair of intensifying screens.

RELATED APPLICATION

Dickerson et al U.S. Ser. No.08/911,483, Aug. 14, 1997, and commonly assigned, titled SINGLE SIDED MAMMOGRAPHIC ELEMENTS, discloses medical diagnostic radiographic element comprised of a film support capable of transmitting radiation to which the radiographic element is responsive having first and second major surfaces, hydrophilic colloid layer units consisting of an imaging layer unit coated on the first major surface including at least one emulsion layer containing radiation-sensitive silver halide grains and an antihalation layer unit coated on the second major surface, wherein to facilitate mammographic imaging with processing times of less than 60 seconds the layer units are fully forehardened and each exhibits a hydrophilic colloid coating coverage of less than 55 mg/dm$^2$ and the radiation-sensitive silver halide grains are coated at a coverage capable of providing a maximum density on processing of greater than 3.6 and, to provide an average mid-scale contrast of greater than 3.0 and an average lower scale contrast of greater than 2.2, the grains (a) exhibit a coefficient of variation grain equivalent circular diameter of less than 15 percent and (b) contain rhodium in a normalized molar concentration of less than $1\times10^{-7}$ based on silver, mid-scale contrast being measured over a density range of from 0.25 to 2.0 above minimum density and lower scale contrast being measured from a reference density of 0.85 above minimum density to a density provided by an exposure of 0.3 log E less than that providing the reference density.

DEFINITION OF TERMS

In referring to grains and emulsions containing two or more halides, the halides are named in order of ascending concentrations.

The term "high bromide" in referring to grains and emulsions indicates that bromide is present in a concentration of greater than 50 mole percent, based on silver.

The term "normalized molar concentration" in referring to rhodium concentrations based on silver, indicates the number of grain-molecular weights of rhodium present per gram-molecular weight of silver, divided (normalized) by the number of rhodium atoms present in the rhodium containing molecule.

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal faces and an aspect ratio of at least 2.

The term "tabular grain emulsion" refers to an emulsion in which tabular grains account for greater than 50 percent of total grain projected area.

The term "coefficient of variation" or "COV" is defined as the standard deviation ($\sigma$) of grain ECD divided by mean grain ECD. COV is multiplied by 100 when stated as a percentage.

The term "log E" is used to indicate the log of exposure in lux-seconds.

The term "mid-scale contrast" or "MSC" is defined as the slope of a line drawn between characteristic curve points at densities of 0.25 and 2.0 above minimum density ($D_{min}$).

The term "lower scale contrast" or "LSC" is defined as the slope of a line drawn between a characteristic curve first reference point at a density of 0.85 above minimum density and a second, lower exposure reference point on the characteristic curve separated from the first reference point by an exposure difference of 0.3 log E.

The terms "front" and "back" in referring to radiographic imaging are used to designate locations nearer to and farther from, respectively, the source of X-radiation than the support of the radiographic element.

The term "dual-coated" is used to indicate a radiographic element having emulsion layers coated on both the front and back sides of its support.

The term "crossover" refers to the light emitted by an intensifying screen mounted adjacent one side of a dual-coated radiographic element that is absorbed by one or more emulsion layers on the opposite side of the radiographic element support.

The term "overall processing" refers to processing that occurs between the time an image-wise exposed element is introduced into a processor and the time the element emerges dry. The processing steps include development, fixing, washing and drying.

The term "rapid access processing" refers to overall processing in less than 90 seconds.

The term "fully forehardened" means that the hydrophilic colloid layers are forehardened in an amount sufficient to reduce swelling of these layers to less than 300 percent, percent swelling being determined by (a) incubating the radiographic element at 38° C. for 3 days at 50 percent relative humidity, (b) measuring layer thickness, (c) immersing the radiographic element in distilled water at 21° C. for 3 minutes, and (d) determining the percent change in layer thickness as compared to the layer thickness measured in step (b).

*Research Disclosure* is published by Kenneth Mason Publications, Ltd., Dudley House, 12 North St., Emsworth, Hampshire P010 7DQ, England.

BACKGROUND

In medical diagnostic imaging X-radiation is passed through a portion of a patient's anatomy. The pattern of X-radiation that passes through the patient is recorded in one or more radiation-sensitive emulsion layers of a radiographic film. To reduce the amount of X-radiation to which the patient must be subjected, the radiographic element is commonly dual-coated—that is, emulsion layers are coated on the front and back sides of the support. This reduces the amount of X-radiation required for imaging by half. A much larger reduction in X-radiation exposure is realized by using an intensifying screen to absorb X-radiation and emit light to the radiographic element for capture by a silver halide emulsion layer. Dual-coated radiographic elements are usually placed between a pair of intensifying screens and mounted in a cassette for exposure. With this arrangement the patient's exposure can be less than one twentieth of that which would otherwise be required to imagewise expose a single emulsion layer directly by X-radiation exposure. For most applications the speed advantage (X-radiation exposure reduction) more than offsets reductions in image sharpness attributable to crossover.

There is no single radiographic element that adequately serves all medical diagnostic needs. The degree to which X-radiation is absorbed varies widely from one anatomical region to the next. For example, lungs, which are filled with air, absorb relatively low levels of X-radiation while much higher levels of X-radiation are absorbed in heart imaging. Also, the feature sought for observation can either differ markedly in its X-radiation absorption from adjacent anatomy, such as a clean break in a bone, or can differ only slightly, such as a lesion or anomaly in soft tissue.

Mammographic diagnostic needs challenge radiographic imaging capabilities. An advanced tumor or cancer can be easily identified, but the diagnostic goal, to maximize survival rates, is to identify cancerous and pre-cancerous growths at the earliest possible stage of development. This is a challenge, since the anatomical feature being sought is, in its earliest stages, a tiny microcalcification and the differences in X-radiation absorption between that feature and healthy tissue is not large.

The types of radiographic elements most generally used for medical diagnostic imaging, with variations for specific diagnostic applications, are dual-coated elements that contain tabular grain emulsion layers on the front and back sides of the support. For example, Dickerson et al U.S. Pat. No. 4,900,652 discloses a radiographic element which is capable of producing maximum densities in the range of from 3 to 4, exhibits reduced crossover and low wet pressure sensitivity, and can be fully processed in a rapid transport processor in less than 90 seconds. The radiographic element is comprised of a spectrally sensitized tabular grain emulsion layer on each opposite side of a transparent film support and processing solution decolorizable dye particles in hydrophilic colloid layers interposed between the emulsion layers and the support. Hydrophilic colloid on each side of the support is in the range of from 35 to 65 mg/dm$^2$, with the interposed layer containing hydrophilic colloid in the amount of at least 10 mg/dm$^2$.

Dickerson et al significantly advanced the state of the art. The spectrally sensitized tabular grain emulsion reduced crossover levels from 30 percent to approximately 20 percent. The dye particles further reduced crossover to less than 10 percent, with the capability of essentially eliminating crossover. The tabular grain emulsions also provided high covering power, allowing full forehardening and lower silver coverages to reach maximum image densities in the range of from 3 to 4. Dickerson et al discloses 35 mg/dm$^2$ of hydrophilic colloid on each major surface of the support to be the minimal amount compatible with achieving low wet pressure sensitivity.

Luckey et al U.S. Pat. No. 4,710,637 discloses an assembly consisting of a pair of intensifying screens and a dual-coated radiographic element for use in soft tissue imaging. Although an assembly of this type was used for mammographic imaging, the image quality was judged inferior by radiologists and the assembly received limited acceptance before its commercial availability was discontinued.

Medical diagnostic radiographic elements intended for mammographic imaging that have been most widely accepted by radiologists contain a single radiation-sensitive emulsion layer containing non-tabular silver halide grains. The single sided emulsion coating format maximizes image sharpness by obviating crossover. The non-tabular silver halide grains allow higher contrasts, particularly higher lower scale contrasts. These radiographic elements, like to those of Dickerson et al, cited above, can be processed in less than 90 seconds, but are incapable of satisfying significantly lower overall processing cycle times.

Dickerson U.S. Pat. No. 5,576,156 discloses a radiographic element having emulsion layers coated on opposite surfaces of a transparent film support. To facilitate rapid processing the emulsion layers are fully forehardened and less than 35 mg/dm$^2$ of hydrophilic colloid is coated on each major surface. To reduce crossover and hydrophilic colloid, emulsions on the opposite sides of the support are each divided into two layers with the layer coated nearest the support containing a particulate dye capable of being decolorized during processing. Particulate dye and silver halide grains together account for between 30 and 70 percent of the total weight of the emulsion layers. Combined with the use of spectrally sensitized tabular grain emulsions crossover can be reduced to less than 15 percent while processing can be completed in less than 45 seconds. The distribution of hydrophilic colloid and silver halide grains chosen achieves low wet pressure sensitivity.

PROBLEM TO BE SOLVED

What the art has been unable to accomplish prior to this invention is to construct a medical diagnostic radiographic element capable of realizing the image quality characteristics of the best performing mammographic elements currently available while allowing acceptable maximum densities to be realized by low silver coating coverages and allowing presently sought shorter overall processing times to be realized while maintaining low levels of wet pressure sensitivity.

SUMMARY OF THE INVENTION

The present invention has as its purpose to provide a medical diagnostic radiographic element that can match the image quality performance characteristics of existing mammographic elements, achieve maximum densities of greater than 3.6 with lower silver coating coverages by employing tabular grain emulsions, and allow overall processing times to be reduced to less than 60 seconds, less than 45 seconds, and even less than 35 seconds.

In one aspect this invention is directed to a radiographic element comprised of a film support having first and second major surfaces and capable of transmitting radiation to which the radiographic element is responsive and, coated on each of the major surfaces, processing solution permeable hydrophilic colloid layers which are fully forehardened including at least one emulsion comprised of silver halide grains, a spectral sensitizing dye adsorbed by the silver halide grains, and a particulate dye (a) capable of absorbing radiation to which the silver halide grains are responsive, (b) present in an amount sufficient to reduce crossover to less than 15 percent, and (c) capable of being substantially decolorized during processing, wherein to facilitate rapid processing and low wet pressure sensitivity, the silver halide grains are coated at a coverage capable of providing an overall radiographic element maximum density on processing of greater than 3.6, less than 35 mg/dm$^2$ of hydrophilic colloid is coated on each of the major surfaces of the support, first and second of the hydrophilic colloid layers each containing a tabular grain emulsion are coated on each major surface of the support with the first layers located nearer the support than the second layers, the second layers contain (a) silver halide grains accounting for from 30 to 70 percent of the total weight of the second layers and accounting for greater than 50 percent of total grain projected area within the second layers, and (b) from 20 to 80 percent of the total silver forming the silver halide grains within the radiographic element, the first layers contain (a) the dye particles and (b) from 20 to 80 percent of the total silver forming the silver halide grains within the radiographic element, the dye particles and the silver halide grains together account for from 30 to 70 percent of the total weight of each of the first layers, and radiation-sensitive silver halide grains within the first and second hydrophilic colloid layers exhibit a coefficient of variation of grain equivalent circular diameter of less than 15 percent and contain rhodium in a normalized molar concentration of less than $1\times10^{-7}$ based on silver to provide a mid-scale contrast of greater than 3.0 and a lower scale contrast of greater than 2.2, where mid-scale contrast is the slope of a line drawn between characteristic curve points at densities of 0.25 and 2.0 above minimum density and lower scale contrast is the slope of a line drawn between a first reference point on the characteristic curve at a density of 0.85 above minimum density and a second, lower exposure reference point on the characteristic curve separated from the first reference by an exposure difference of 0.3 log E, where log E is the log of exposure in lux-seconds.

DESCRIPTION OF PREFERRED EMBODIMENTS

Assembly A

This is an assembly of a radiographic element according to the invention positioned between two intensifying screens.

FS Front Screen
SS1 Screen Support
FLE Front Luminescence Emitting Layer
RE Radiographic Element
FE2 Second Front Hydrophilic Colloid Layer
FE1 First Front Hydrophilic Colloid Layer
S1 Subbing Layer
TF Transparent Film Support
S2 Subbing Layer
BE1 First Back Hydrophilic Colloid Layer
BE2 Second Back Hydrophilic Colloid Layer
BS Back screen
BLE Back Luminescence Emitting Layer
SS2 Screen Support Assembly A is shown comprised of a medical diagnostic radiographic element RE satisfying mammographic imaging requirements positioned between front and back intensifying screens FS and BS comprised of supports SS1 and SS2 and layers FLE and BLE that absorb X-radiation and emit light.

Located between the screens when intended to be imagewise exposed is radiographic element RE satisfying the requirements of the invention. The radiographic element is comprised of a transparent support TF, which is usually a transparent film support and is frequently blue tinted. To facilitate coating onto the support, subbing layers S1 and S2 are shown. Subbing layers are formed as an integral part of transparent film supports, but are not essential for all types of transparent supports. The transparent support and the subbing layers are all transparent to light emitted by the intensifying screens and are also processing solution impermeable. That is, they do not ingest water during processing and hence do not contribute to the "drying load"—the water that must be removed to obtain a dry imaged element.

First and second hydrophilic colloid layers FE1 and FE2, respectively, are coated on the major surface of the support positioned adjacent the front intensifying screen. Similarly, first and second hydrophilic colloid layers BE1 and BE2 are coated on the major surface of the support positioned adjacent the back intensifying screen. Also usually present, but not shown, are hydrophilic colloid layers, referred to as surface overcoats, that overlie FE2 and BE2 and perform the function of physically protecting the underlying hydrophilic colloid layers during handling and processing. In addition to hydrophilic colloid the overcoats can contain matting agents, antistatic agents, lubricants and other non-imaging addenda at or near the surface of the element. It is also common practice to coat a hydrophilic colloid interlayer between a surface overcoat and underlying emulsion layers. The interlayer can contain the same types of addenda as the surface overcoat, but is also commonly free of addenda, thereby acting primarily simply to provide a physical separation between the surface overcoat and its addenda and the underlying emulsion layers.

The medical diagnostic radiographic elements of the invention satisfying mammographic imaging requirements differ from radiographic elements previously available in the art by offering a combination of advantageous characteristics never previously realized in a single radiographic element:

(1) Full forehardening.
(2) Maximum image densities in the range of from 3 to 4.
(3) Crossover of less than 15 percent.
(4) Processing in less than 45 seconds.
(5) Low wet pressure sensitivity.
(6) Relatively high levels of sensitivity.
(7) A mid-scale contrast of greater than 3.0 and a lower scale contrast of greater than 2.2.

While prior to the present invention the combination of characteristics (1)–(7) have been thought to impose incompatible construction requirements, by a combination of careful selection of components and a realization of unexpected performance characteristics, this invention succeeds for the first time in combining all of these characteristics in a single radiographic element.

The radiographic element RE is fully forehardened. This better protects the radiographic element from damage in handling and processing and simplifies processing by eliminating any necessity of completing hardening during processing. Full forehardening is achieved by hardening the hydrophilic colloid layers. The levels of forehardening of a fully forehardened radiographic element are similar to those employed in forehardening photographic elements. A summary of vehicles for photographic elements including hydrophilic colloids, employed as peptizers and binders, and useful hardeners is contained in *Research Disclosure,* Vol. 389, September 1996, Item 38957, Section II. Vehicles, vehicle extenders, vehicle-like addenda and vehicle related addenda. Preferred vehicles for the hydrophilic colloid layers FE1, FE2, BE1 and BE2 as well as protective overcoats, if included, are gelatin (e.g., alkali-treated gelatin or acid-treated gelatin) and gelatin derivatives (e.g., acetylated gelatin or phthalated gelatin). Although conventional hardeners can be used more or less interchangeably with little or no impact on performance, particularly preferred are the bis (vinylsulfonyl) class of hardeners, such as bis(vinylsulfonyl) alkylether or bis(vinylsulfonyl)alkane hardeners, where the alkyl moiety contains from 1 to 4 carbon atoms.

For the radiographic element to be capable of forming an image, it must include at least one radiation-sensitive silver halide emulsion. The fully forehardened characteristic (1) restricts the choices of the silver halide emulsions in the following manner: It is well recognized in the art that silver image covering power can decline as a function of increased levels of forehardening. Covering power is expressed as image density divided by silver coating coverage. For example, Dickerson U.S. Pat. No. 4,414,304 defines covering power as 100 times the ratio of maximum density to developed silver, expressed in mg/dm$^2$. Dickerson recognized that tabular grain emulsions are less susceptible to covering power reduction with increasing levels of forehardening.

If the hydrophilic colloid layers are not fully forehardened, excessive water pick up during processing prevents processing in less than 45 seconds, characteristic (4). If tabular grain emulsions are not employed, excessive amounts of silver must be coated to realize characteristic (2), and characteristics (4) and (5) cannot be both realized. If the hydrophilic colloid is increased in proportion to the increase in silver, processing cannot be completed in less than 45 seconds. If silver is increased without increasing the hydrophilic colloid, the processed radiographic element will show localized density marks indicative of roller pressure applied in passing the exposed element through the processor, generally referred to as wet pressure sensitivity. Tabular grain emulsions frequently display higher levels of wet pressure sensitivity than nontabular grain emulsions.

With various other selections discussed below, all of characteristics (1)–(7) listed above can be realized by the presence in each of the hydrophilic colloid layers FE1, FE2, BE1 and BE2 of at least one spectrally sensitized tabular grain emulsion in which the radiation-sensitive silver halide grains exhibit a coefficient of variation (COV) of less than 15 percent and contain rhodium in a normalized molar concentration of less than $1\times10^{-7}$ based on silver and placement in the hydrophilic colloid layers FE1 and BE1 of a particulate dye to assist in crossover reduction to less than 15 percent.

Tabular grain silver halide emulsions contemplated for use in the practice of the invention can be of any of the following silver halide compositions: silver chloride, silver bromide, silver iodobromide, silver chlorobromide, silver bromochloride, silver iodochloride, silver iodochlorobromide and silver iodobromochloride, where the mixed halides are named in order of ascending concentrations. Since it is recognized that the presence of iodide slows grain development, it is advantageous to choose emulsions that contain no iodide or only limited levels of iodide. Iodide concentrations of less than 4 mole percent, based on silver, are specifically preferred. Of the three photographic halides (chloride, bromide and iodide), silver chloride has the highest solubility and hence lends itself to achieving the highest rates of development. It is therefore preferred in terms of achieving characteristic (4). When characteristics (4) and (6) are considered together, silver chlorobromide and silver bromide compositions are preferred.

To most conveniently realize characteristic (7) and to realize characteristic (2) with low silver coating coverages the tabular grain emulsions are chosen so that tabular grains having thicknesses of less than 0.3 $\mu$m, preferably less than 0.2 $\mu$m, in thickness account for greater than 70 percent and preferably at least 90 percent of total grain projected area. Although the covering power the tabular grains increases as their thickness is decreased, it is usually preferred to maintain average tabular grain thicknesses of at least about 0.1 $\mu$m to avoid undesirably warm image tones in the fully processed mammographic images. To avoid excessive granularity and hence high levels of image noise incompatible with identifying microcalcifications in mammographic images, it is contemplated to employ tabular grain emulsions with mean ECD's of less than 3.0 $\mu$m and preferably less than 2.5 $\mu$m.

The radiation-sensitive silver halide grains in the first and second hydrophilic colloid layers have coefficients of variation of less than 15 percent and preferably less than 10 percent. These relatively low levels of grain ECD dispersity provide an essential contribution toward satisfying characteristic (7) above.

Tabular grain emulsions satisfying the requirements of the invention can be prepared with low coefficients of variation by employing techniques such as those taught by *Research Disclosure,* Item 38957, I. Emulsion grains and their preparation, E. Blends, layers and performance characteristics, paragraph (2). Preferred emulsion precipitations that produce tabular grain emulsions with COV's of less than 15 percent and, in preferred forms, less than 10 percent, are disclosed by Tsaur et al U.S. Pat. Nos. 5,147,771, 5,147,772, 5,147,773, 5,147,774 and 5,210,013; Kim et al U.S. Pat. Nos. 5,236,817 and 5,272,048; and Sutton et al U.S. Pat. No. 5,300,413, the disclosures of which are here incorporated by reference.

In most conventional film constructions the choice of low coefficient of variation tabular grain emulsions would in itself allow mid-scale and lower scale contrasts in a range useful for radiography to be achieved. Unfortunately, to realize simultaneously overall processing in less than 45 seconds and crossover over less than 15 percent, the radiographic elements of this invention require the presence of dye particles in the first hydrophilic colloid layers. This prevents acceptable average and lower scale contrasts being realized merely by decreasing grain size dispersity (i.e., lowering COV).

It has been discovered quite unexpectedly that the addition of limited amounts of rhodium as a dopant in the radiation-sensitive silver halide grains is capable of increasing mid-scale and lower scale contrasts into acceptable ranges for mammographic imaging without any significant adverse effect on imaging speed. Keller *Science and Technology of Photography,* VCH, New York, 1993, at page 40 states:

> A fundamentally different approach to high gradation values is the doping of the emulsion grains with heavy-metal ion such as those of rhodium, cadmium, lead and bismuth. Doping pushes back the toe of the characteristic curve and produces a steep gradation.

The expression "pushes back the toe" means simply that more light exposure is required before density rises above a minimum level. Whereas the art has heretofore regarded attaining increased contrasts with rhodium incompatible with maintaining high levels of imaging speed, it has been observed that by limiting the rhodium dopant to a normalized molar concentration of less $1\times10^{-7}$ based on silver, no significant reduction is speed is observed.

This observation is particularly important for mammography. For many types of imaging applications a speed reduction attributable to rhodium doping can be readily overcome merely by increasing the mean ECD of the silver halide grains, since it is well known that imaging speed generally increases with increasing mean grain sizes.

However, the small sizes of the microcalcifications sought to be identified limit freedom to increase mean grain size, since the latter also increases granularity (image noise). Attempting medical diagnoses with grainy images runs a significant risk of failing to identify the presence of microcalcifications.

It has been discovered quite unexpectedly that contrast enhancement without significant reduction in imaging speed can be realized by limiting the normalized molar concentration of rhodium to less than $1\times10^{-7}$ based on silver. Any lower concentration of rhodium can be employed that raises average and lower scale contrasts above 3.0 and 2.2, respectively. In most instances it is contemplated that rhodium will be present in a normalized molar concentration of at least $1\times10^{-9}$, based on silver, and most typically rhodium normalized molar concentrations in the range of from $5\times10^{-9}$ to $5\times10^{-8}$ based on silver are preferred.

Any conventional rhodium compound known to be useful in doping silver halide grains can be employed in the practice of the invention. A variety of rhodium and other conventional silver halide grain dopants are disclosed by *Research Disclosure,* Item 38957, I. Emulsions and their preparation, D. Grain modifying conditions and adjustments, paragraphs (3), (4) and (5). Rhodium can be introduced as a simple salt, preferably a halide salt. It is now believed rhodium forms a hexacoordination complex prior to incorporation in the crystal lattice of a silver halide grain. Thus, in most instances rhodium hexahalides are preferred dopants, with up to two halide atoms being sometimes replaced with aquo ligands. Preferred halides in the rhodium compounds are chloride and bromide. Paragraphs (4) and (5) provide specific illustrations of other ligands, including organic ligands, that can be present in rhodium hexacoordination complexes.

Rhodium dopants are compatible with other conventional dopants. Combinations of rhodium and speed increasing dopants, particularly shallow electron trapping dopants, such as those described in *Research Disclosure,* Vol. 367, Nov. 1994, Item 36736, and Olm et al U.S. Pat. No. 5,503,970, here incorporated by reference, are specifically contemplated. Conventional iridium dopants can also be employed in combination with rhodium dopants. Iridium dopants, like rhodium dopants, are believed to enter the silver halide grain crystal lattice as hexacoordination complexes, most commonly iridium hexahalide coordination complexes.

When tabular grain emulsions satisfying the requirements set forth above are employed, total silver coating coverages in the range of greater than 35 are capable upon processing of producing a silver image having a maximum density greater than 3.6. It is preferred to employ silver coating coverages in the range of from >35 to 60 mg/dm$^2$. Higher silver coating coverages are unnecessary, since maximum densities greater than 4 do provide additional visually accessible image information.

If all of the radiation-sensitive silver halide grains are spectrally sensitized, this alone is capable of reducing crossover to just less than 20 percent, as illustrated by Abbott et al U.S. Pat. Nos. 4,425,425 and 4,425,426 (hereinafter referred to collectively as Abbott et al).

All references to crossover percentages are based on the crossover measurement technique described in Abbott et al, here incorporated by reference. The crossover of a radiographic element according to the invention under the contemplated conditions of exposure and processing can be determined by substituting a black object (e.g., kraft paper) for one of the two intensifying screens. To provide a verifiable standard for measuring percent crossover, the exposure and processing described in the Examples, below, should be employed. Exposure through a stepped density test object exposes primarily the emulsion on the side of the radiographic element nearest the intensifying screen, but the emulsion on the side of the radiographic element farthest from the intensifying screen is also exposed, but to a more limited extent by unabsorbed light passing through the support. By removing emulsion from the side of the support nearest the intensifying screen in one sample and the side of the support farther from the intensifying screen in another sample, a characteristic curve (density vs. log E, where E is the light passing through the stepped test object) can be plotted for each emulsion remaining. The characteristic curve of the emulsion on the side farthest from the substituted light source is laterally displaced as compared to the characteristic curve of the emulsion on the side nearest the substituted light source. An average displacement ($\Delta\log E$) is determined and used to calculate percent crossover as follows:

$$\text{Percent Crossover} = \frac{1}{\text{antilog}(\Delta\log E)} \times 100$$

If screen emission is in the spectral region to which silver halide possesses native sensitivity, then the silver halide grains themselves contribute to light absorption and therefore crossover reduction. This occurs to a significant extent only at exposure wavelengths of less than 425 nm. Spectral sensitizing dye adsorbed to the grain surfaces is primarily relied upon for absorption of light emitted by the screens. The silver halide emulsions can contain any conventional spectral sensitizing dye or dye combination adsorbed to the grain surfaces. Typically dye absorption maxima are closely matched to the emission maxima of the screens so that maximum light capture efficiency is realized. To maximize speed (6) and minimize crossover (3), it is preferred to adsorb dye to the grain surfaces in a substantially optimum amount—that is, in an amount sufficient to realize at least 60 percent of maximum speed under the contemplated conditions of exposure and processing. To provide an objective standard for reference the conditions of exposure and processing set out in the Examples below can be employed. Illustrations of spectral sensitizing dyes useful with the radiographic elements of the invention are provided by Kofron et al U.S. Pat. No. 4,439,520, here incorporated by reference, particularly cited for its listing of blue spectral sensitizing dyes. Abbott et al U.S. Pat. Nos. 4,425,425 and 4,425,426 also illustrate the use of spectral sensitizing dyes to reduce crossover. A more general summary of spectral sensitizing dyes is provided by *Research Disclosure,* Item 38957, cited above, Section V. Spectral sensitization and desensitization, A. Sensitizing dyes.

To reduce crossover to less than 15 percent and, preferably, to less than 10 percent it is contemplated to introduce additional dye capable of absorbing within the wavelength region of exposure into the hydrophilic colloid layers FE1 and BE1. The additional dye is chosen to absorb exposing light that is not absorbed by the silver halide grains and spectral sensitizing dye contained in hydrophilic colloid layers FE2 and BE2. If the additional dye is incorporated into the hydrophilic colloid layers FE2 and BE2 as well, the result is a marked reduction in photographic speed. In addition to its absorption properties the additional dye must be capable of being decolorization during processing.

Dickerson et al U.S. Pat. Nos. 4,803,150 and 4,900,652, here incorporated by reference, disclose particulate dyes capable of (a) absorbing radiation to which the silver halide grains are responsive to reduce crossover to less than 15 percent and (b) being substantially decolorized during processing. The particulate dyes can, in fact, substantially eliminate crossover. The mean ECD of the dye particles can range up to 10 μm, but is preferably less than 1 μm. Dye particle sizes down to about 0.01 μm can be conveniently formed. Where the dyes are initially crystallized in larger than desired particle sizes, conventional techniques for achieving smaller particle sizes can be employed, such as ball milling, roller milling, sand milling, and the like.

Since the hydrophilic colloid layers are typically coated as aqueous solutions in the pH range of from 5 to 6, most typically from 5.5 to 6.0, the dyes are selected to remain in particulate form at those pH levels in aqueous solutions. The dyes must, however, be readily soluble at the alkaline pH levels employed in photographic development. Dyes satisfying these requirements are nonionic in the pH range of coating, but ionic under the alkaline pH levels of processing. Preferred dyes are nonionic polymethine dyes, which include the merocyanine, oxonol, hemioxonol, styryl and arylidene dyes. In preferred forms the dyes contain carboxylic acid substituents, since these substituents are nonionic in the pH ranges of coating, but are ionic under alkaline processing conditions.

Specific examples of particulate dyes are described by Lemahieu et al U.S. Pat. No. 4,092,168, Diehl et al WO 88/04795 and EPO 0 274 723, and Factor et al EPO 0 299 435, Factor et al U.S. Pat. No. 4,900,653, Diehl et al U.S. Pat. No. 4,940,654 (dyes with groups having ionizable protons other than carboxy), Factor et al U.S. Pat. No. 4,948,718 (with arylpyrazolone nucleus), Diehl et al U.S. Pat. No. 4,950,586, Anderson et al U.S. Pat. No. 4,988,611 (particles of particular size ranges and substituent pKa values), Diehl et al U.S. Pat. No. 4,994,356, Usagawa et al U.S. Pat. No. 5,208,137, Adachi U.S. Pat. No. 5,213,957 (merocyanines), Usami U.S. Pat. No. 5,238,798 (pyrazolone oxonols), Usami et al U.S. Pat. No. 5,238,799 (pyrazolone oxonols), Diehl et al U.S. Pat. No. 5,213,956 (tricyanopropenes and others), Inagaki et al U.S. Pat. No. 5,075,205, Otp et al U.S. Pat. No. 5,098,818, Texter U.S. Pat. No. 5,274,109, McManus et al U.S. Pat. No. 5,098,820, Inagaki et al EPO 0 385 461, Fujita et al EPO 0 423 693, Usui EPO 0 423 742 (containing groups with specific pKa values), Usagawa et al EPO 0 434 413 (pyrazolones with particular sulfamoyl, carboxyl and similar substituents), Jimbo et al EPO 0 460 550, Diehl et al EPO 0 524 593 (having alkoxy or cyclic ether substituted phenyl substituents), Diehl et al EPO 0 524 594 (furan substituents) and Ohno EPO 0 552 646 (oxonols).

If all of the silver halide required for imaging is located in the hydrophilic colloid layers FE2 and BE2, it is impossible to satisfy characteristics (4) and (5). If hydrophilic colloid is reduced to less than 35 mg/dm$^2$ per side, processing in less than 45 seconds (4) can be realized, but high levels of wet pressure sensitivity are observed. Wet pressure sensitivity is observed as uneven optical densities in the fully processed image, attributable to differences in guide roller pressures applied in rapid processing. If the amount of hydrophilic colloid in the layers FE2 and BE2 is increased to an extent necessary to eliminate visible wet pressure sensitivity, the radiographic element cannot be processed in less than 45 seconds.

It has been discovered that successful rapid processing and low levels of wet pressure sensitivity can be both realized if a portion of the spectrally sensitized radiation-sensitive silver halide relied upon for imaging is incorporated in the hydrophilic colloid layers FE1 and BE1. Surprisingly, as demonstrated in the Examples below, when a portion of the spectrally sensitized radiation- sensitive silver halide is coated in the hydrophilic colloid layers containing the particulate dye used for crossover reduction, fully acceptable photographic speeds can still be maintained. This is in direct contradiction to observations that particulate dye and silver halide emulsion blending in a single hydrophilic colloid result in unacceptably low levels of photographic speed. By incorporating both a portion of the silver halide emulsion and the particulate dye in hydrophilic colloid layers FE1 and BE1, it is possible to reduce the total coverage of hydrophilic colloid per side of the radiographic elements of the invention to less than 35 mg/dm$^2$, preferably less than 33 mg/dm$^2$ while satisfying characteristics (1)–(7). In preferred forms of the invention, the low levels of hydrophilic colloid per side allow processing characteristic (4) to be reduced to less than 35 seconds.

To satisfy characteristics (1)–(7), from 20 to 80 (preferably 30 to 70) percent of the total silver forming the radiographic element must be contained in the hydrophilic colloid layers FE2 and BE2. Similarly, from 20 to 80 (preferably 30 to 70) percent of the total silver forming the radiographic element must be contained in the hydrophilic colloid layers FE1 and BE1. It is generally preferred that at least 50 percent of the total silver forming the radiographic element be contained in the hydrophilic colloid layers FE2 and BE2.

In addition, to satisfy characteristics (1)–(7), the silver halide grains in hydrophilic colloid layers FE2 and BE2 account for from 30 to 70 (preferably 40 to 60) percent of the total weight of these layers. Similarly, in hydrophilic colloid layers FE1 and BE1 the silver halide grains and dye particles together account for from 30 to 70 (preferably 40 to 60) percent of the total weight of these layers.

Specific selections of remaining features of the radiographic element RE can take any convenient conventional form compatible with the descriptions provided. For example, transparent film supports and the subbing layers that are typically provided on their major surfaces to improve the adhesion of hydrophilic colloid layers are disclosed in *Research Disclosure,* Item 38957, Section XV. Supports and in *Research Disclosure,* Item 18431, Section XII. Film Supports. Chemical sensitization of the emulsions is disclosed in *Research Disclosure,* Item 36544, Section IV. Chemical sensitization and *Research Disclosure,* Item 18431, Section I.C. Chemical Sensitization/Doped Crystals. The chemical sensitization of tabular grain emulsions is more particularly taught in Kofron et al U.S. Pat. No. 4,429,520, here incorporated by reference.

The following sections of *Research Disclosure,* Item 18431 summarize additional features that are applicable to the radiographic elements of the invention:

II. Emulsion Stabilizers, Antifoggants and Antikinking Agents

III. Antistatic Agents/Layers

IV. Overcoat Layers

The following sections of *Research Disclosure,* Item 38957 summarize additional features that are applicable to the radiographic elements of the invention:

VII. Antifoggants and stabilizers

IX. Coating physical property modifying addenda

A. Coating aids

B. Plasticizers and lubricants

C. Antistats

D. Matting Agents

EXAMPLES

The invention can be better appreciated by consideration in connection with the following specific embodiments. The letters C and E are appended to element numbers to differentiate control and example radiographic elements. All coating coverages are in mg/dm$^2$, except as otherwise indicated.

Radiographic Element A (Control)

A conventional single-side mammographic element was provided having the following format:

| |
|---|
| Surface Overcoat (SOC) |
| Interlayer (IL) |
| Emulsion Layer (EL) |
| Transparent Film Support |
| Pelloid Layer (PL) |
| Surface Overcoat (SOC) |

| Contents | Coverage |
|---|---|
| **Surface Overcoat (SOC)** | |
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |
| **Interlayer (IL)** | |
| Gelatin | 3.4 |
| AgI Lippmann | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| **Emulsion Layer (EL)** | |
| Ag | 43.0 |
| Gelatin | 43.0 |
| 4-Hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium Bromide | 0.14 |
| Resorcinol | 0.44 |
| Bis(vinylsulfonylmethyl)ether (based on wt. of gelatin in all layers of the front side of the support) | 0.7% |
| **Pelloid Layer** | |
| Gelatin | 43.0 |
| Dye AH-1 | 2.4 |
| Dye AH-2 | 1.1 |
| Dye AH-3 | 0.8 |
| Dye AH-4 | 6.9 |
| Bis(vinylsulfonylmethyl)ether (based on wt. of gelatin on the back side of the support) | 2.4% |

The transparent film support was a blue tinted 7 mil (177.8 $\mu$m) transparent polyester film support.

The silver halide emulsion employed was a green sensitized silver iodobromide emulsion containing 1 mole percent iodide, based on silver. The silver halide grains were non-tabular and exhibited a mean ECD of 0.7 $\mu$m. The emulsion was chemically sensitized with sodium thiosulfate, potassium tetrachloroaurate, sodium thiocyanate and potassium selenocyanate and spectrally sensitized with 170 mg/Ag mol of anhydro-5,5-dichloro- 9-ethyl-3,3'-bis(3-sulfopropyl) oxacarbocyanine hydroxide (Dye SS-1).

The four antihalation dyes were employed:

AH- 1. Bis[3-methyl-1-(p-sulfophenyl)-2-pyrazolin-5-one-(4)]monomethineoxonol.

AH-2. Bis(1-butyl-3-carboxymethyl-5-barbituric acid) trimethineoxonol.

AH-3. 4-[4-(3-ethyl-2(3H)-benzoxazolylidene-2-butenylidene]-3-methyl-1-p-sulfophenyl-2-pyrazolin-5-one, monosulfonated.

AH-4. Bis[3-methyl-1-(p-sulfophenyl)-2-pyrazolin-5-one-(4)]pentamethineoxonol.

Radiographic Element B (Example)

Radiographic element B was a dual-coated radiographic element exhibiting the following overall format:

| |
|---|
| Surface Overcoat (SOC) |
| Interlayer (IL) |
| Overlying Emulsion Layer (OEL) |
| Underlying Emulsion Layer (UEL) |
| Transparent Film Support |
| Underlying Emulsion Layer (UEL) |
| Overlying Emulsion Layer (OEL) |
| Interlayer (IL) |
| Surface Overcoat (SOC) |

The same support was employed as in control Radiographic Element A.

In the overlying and underlying emulsion layers a tabular grain silver bromide emulsion, Emulsion T, was employed.

Emulsion T was precipitated in the following manner: In an 18 liter reaction vessel was placed an aqueous gelatin solution composed of 6 L of water, 7.5 g of alkali processed gelatin treated with an oxidizing agent to reduce methionine (hereinafter referred to as oxidized gelatin), 8.9 mL of 4M nitric acid solution, 3.8 g of sodium bromide, and 0.60 g of Pluronic™ 31R1, which satisfies the formula:

$$HO\text{-}[CH(CH_3)CH_2O]x\text{-}(CH_2CH_2O)y\text{-}[CH_2(CH_3)CH]x'\text{-}H$$

x and x' each=25 and y=7.

At 45° C., 50 mL of a 0.50M aqueous silver nitrate solution and 49 mL of a 0.53M aqueous sodium bromide solution were simultaneously added over a period of 1 minute at a constant rate. Then, 115 mL of a 1M aqueous sodium bromide solution was added to the mixture. After 1 minute of mixing, the temperature was raised to 60° C. over a period of 9 minutes. At that time 100 mL of 1.15M aqueous ammonium sulfate solution and 130 mL of a 2.5M sodium hydroxide solution were added. The mixture was stirred for a period of 9 minutes. Then, to the mixture was added 1.5L of an aqueous gelatin solution composed of 100 g of oxidized gelatin, 25.52 mL of a 4M nitric acid solution, and 0.15 g of Pluronic™ 31R1. The mixture was stirred for a period of 2 minutes. Thereafter, 150 mL of a 0.50M aqueous silver nitrate solution, and 155 mL of a 0.53M aqueous sodium bromide solution were simultaneously added at a constant rate for a period of 10 minutes. Then, 2.92L of a 2.60M aqueous silver nitrate solution and 2.90L of a 2.68M aqueous sodium bromide solution containing 0.86 mL of a 0.146 mM aqueous ammonium hexachlororhodate(III) solution were simultaneously added to the mixture at a constant ramp starting from respective rates of 5.0 mL/min and 5.2 mL/min for the subsequent 79 minutes. Then 1.39L of a 2.6M aqueous silver nitrate solution and 1.38L of a 2.68M aqueous sodium bromide solution with 0.45 mL of 0.146 mM aqueous ammonium hexachlororhodate(III) were simultaneously added to the mixture at a constant rate over a period of 20.2 minutes, and 1.2 minutes into this period 2 mL of a 0.12 mM solution potassium hexachloroiriradte(IV) solution was added over a period of 2 minutes. The emulsion was then washed.

Emulsion T had a mean grain ECD of 2.0 $\mu$m and a mean grain thickness of 0.13 $\mu$m. Tabular grains accounted for greater than 90 percent of total grain projected area, and the grain size COV of the emulsion was 7 percent. The silver bromide grains were doped with $9.7\times10^{-9}$ mole per silver mole of rhodium introduced by addition of $(NH_4)_3RhCl_6$ during grain precipitation. Iridium was added as a dopant to reduce reciprocity failure, since mammographic films in varied uses receive widely varying exposure times.

The tabular grain emulsion was chemically sensitized with sodium thiosulfate, potassium tetrachloroaurate, sodium thiocyanate and potassium selenocyanate and spectrally sensitized with 400 mg/Ag mol of Dye SS-1, followed by 300 mg/Ag mol of potassium iodide.

| Contents | Coverage |
|---|---|
| Overlying Emulsion Layer (OEL) | |
| Ag | 10.8 |
| Gelatin | 13.0 |
| 4-Hydroxy-6-methyl-1,3,3a,7-tetraazaindene | 2.1 g/Ag mole |
| Potassium nitrate | 0.83 |
| Ammonium hexachloropalladate | 0.001 |
| Maleic acid hydrazide | 0.0044 |
| Sorbitol | 0.24 |
| Glycerin | 0.26 |
| Potassium Bromide | 0.14 |
| Resorcinol | 0.2 |
| Underlying Emulsion Layer (UEL) | |
| Ag | 10.8 |
| Gelatin | 13.0 |
| Microcrystalline dye | 1.08 |
| 4-Hydroxy-6-methyl-1,3,3a,7-tetraazaindene | 2.1 g/Ag mole |
| Potassium nitrate | 0.83 |
| Ammonium hexachloropalladate | 0.001 |
| Maleic acid hydrazide | 0.0044 |
| Sorbitol | 0.24 |
| Glycerin | 0.26 |
| Potassium Bromide | 0.06 |
| Resorcinol | 0.2 |
| Bis(vinylsulfonylmethyl)ether (based on wt. of gelatin in all layers on the coated on the same side of the support) | 2.5% |

The microcrystalline dye was 1-(4'-carboxyphenyl)-4-(4'-dimethylaminobenzylidene) -3-ethoxycarbonyl-2-pyrazolin-5-one.

| Contents | Coverage |
|---|---|
| Interlayer (IL) | |
| Gelatin | 3.4 |
| AgI Lippmann | 0.11 |
| Carboxymethyl casein | 0.57 |
| Colloidal silica | 0.57 |
| Polyacrylamide | 0.57 |
| Chrome alum | 0.025 |
| Resorcinol | 0.058 |
| Nitron | 0.044 |
| Surface Overcoat (SOC) | |
| Gelatin | 3.4 |
| Poly(methyl methacrylate) matte beads | 0.14 |
| Carboxymethyl casein | 0.57 |
| Colloidal silica | 0.57 |
| Polyacrylamide | 0.57 |
| Chrome alum | 0.025 |
| Resorcinol | 0.058 |
| Whale oil lubricant | 0.15 |

Radiographic Element C (Control)

This radiographic element was constructed identically as example radiographic element B, except that the rhodium dopant was omitted from the silver bromide grains.

Radiographic Element D (Control)

This radiographic element was constructed identically as radiographic element C, except that the tabular grain emulsion employed exhibited a grain size dispersity COV of 38 percent.

Evaluations

Samples of the dual-coated elements were simultaneously exposed on each side for 1/50 sec through a graduated density step tablet using a MacBeth™ sensitometer having a 500 watt General Electric DMX™ projector lamp calibrated to 2650° K and filtered through a Corning C4010™ filter (480–600 nm, 530 nm peak transmission). The single sided element was similarly exposed, but only on the emulsion side.

The samples were processed using a Kodak X-Omat RA 480 processor. This processor can be set to any one of the overall processing cycles set out in Table I.

TABLE I

Cycle Times in Seconds

| Cycle | Extended | Standard | Rapid | KWIK | Super KWIK |
|---|---|---|---|---|---|
| Develop | 44.9 | 27.6 | 15.1 | 11.1 | 8.3 |
| Fix | 37.5 | 18.3 | 12.9 | 9.4 | 7.0 |
| Wash | 30.1 | 15.5 | 10.4 | 7.6 | 5.6 |
| Dry | 47.5 | 21.0 | 16.6 | 12.2 | 9.1 |
| Total | 160.0 | 82.4 | 55 | 40.3 | 30.0 |

The processing cycles employed the following developers and fixers, where component concentrations are expressed in g/L:

| Extended, Standard and Rapid developer: | |
|---|---|
| Hydroquinone | 30 |
| 4-Hydroxymethyl-4-methyl-1-phenyl-3-pyrazolidinone | 1.5 |
| Potassium hydroxide | 21.00 |
| 5-Methylbenzotriazole | 0.06 |
| Sodium bicarbonate | 7.5 |
| Potassium sulfite | 44.2 |
| Sodium metabisulfite | 12.6 |
| Sodium bromide | 35.0 |
| Glutaraldehyde | 4.9 |
| Water to 1 liter | |
| pH 10 | |

The glutaraldehyde functioned to complete hardening of Element A, but had little effect on the remaining elements, which were fully forehardened.

| Extended, Standard and Rapid fixer: | |
|---|---|
| Ammonium thiosulfate, 60% | 260 |
| Sodium bisulfite | 180 |
| Boric acid | 25 |
| Acetic acid | 10 |
| Aluminum sulfate | 8 |
| Water to 1 liter | |
| pH 3.9 to 4.5 | |

-continued

KwiK developer:

| | |
|---|---|
| Hydroquinone | 32 |
| 4-Hydroxymethyl-4-methyl-1-phenyl-3-pyrazolidinone | 6.0 |
| Potassium bromide | 2.25 |
| 5-Methylbenzotriazole | 0.125 |
| Sodium sulfite | 160 |
| Glutaraldehyde | 4.9 |
| Water to 1 liter | |
| pH 10.5 | |

Kwik fixer:

| | |
|---|---|
| Potassium hydroxide | 3.2 |
| Glacial acetic acid | 9.6 |
| Ammonium thiosulfate | 100 |
| Ammonium sulfite | 7.1 |
| Sodium tetraborate pentahydrate | 4.4 |
| Tartaric acid | 3.0 |
| Sodium metabisulfite | 6.6 |
| Aluminum sulfate | 3.3 |
| Water to 1 liter | |
| pH 4.9 | |

Super Kwik developer:

| | |
|---|---|
| Potassium hydroxide | 23 |
| Sodium sulfite | 12 |
| 1-Phenyl-5-mercaptotetrazole | 0.02 |
| Sequestrant* | 2.8 |
| Sodium bicarbonate | 7.4 |
| Potassium sulfite | 70.8 |
| Diethylene glycol | 15 |
| Hydroquinone | 30 |
| Glutaraldehyde | 3.9 |
| Glacial acetic acid | 10 |
| 1-Phenyl-3-pyrazolidone | 12 |
| 5-nitroindazole | 0.12 |
| Water to 1 liter | |
| pH 10.6 | |

Super Kwik fixer:

| | |
|---|---|
| Potassium hydroxide | 7.4 |
| Acetic acid | 18 |
| Sodium thiosulfate | 16 |
| Potassium iodide | 0.08 |
| Ammonium thiosulfate | 122 |
| Ammonium sulfite | 8.6 |
| Sodium metabisulfite | 2.9 |
| Sodium glutonate | 5.0 |
| Aluminum sulfate | 7.0 |
| Water to 1 liter | |
| pH 4.7 | |

*diethylenetriaminopentaacetic acid pentasodium salt

The glutaraldehyde functioned to complete hardening of Element A, but had little effect on the remaining elements, which were fully forehardened.

To compare the ability of the processor to dry the film samples, samples of the Elements were flash exposed to provide a density of 1.0 when processed. As each film sample started to exit the processor, the processor was stopped, and the sample was removed from the processor. Roller marks were visible on the film in areas that had not dried. A film that was not dry as it left the processor was assigned a % dryer value of 100+. A film that exhibited roller marks from first encountered guide rollers, but not the later encountered guide rollers, indicating that the film had already dried when passing over the latter rollers, was assigned a % dryer value indicative of percentage of the rollers that were guiding undried portions of the film. Hence lower % dryer values indicate quicker drying film samples.

To permit crossover determinations samples of the Elements were exposed with a Lanex Regular™ green emitting intensifying screen in contact with one side of the sample and black kraft paper in contact with the other side of the sample. The X-radiation source was a Picker VGX653 3-phase X-ray machine, with a Dunlee High-Speed PX143 1-CQ-150 kVp 0.7/1.4 focus tube. Exposure was made at 70 kVp, 32 mAs, at a distance of 1.40 m. Filtration was with 3 mm Al equivalent (1.25 inherent+1.75 Al); Half Value Layer (HVL)-2.6 mm Al. A 26 step Al step wedge was used, differing in thickness by 2 mm per step.

Processing of these samples was undertaken as described above. By removing emulsion from the side of the support nearest the screen at some sample locations and from the side of the support opposite the screen at other sample locations the density produced on each side of the support at each step was determined. From this separate characteristic (density vs. log E) curves were plotted for each emulsion layer. The exposure offset between the curves was measured at three locations between the toe and shoulder portions of the curves and averaged to obtain Δ log E for use in equation (I), above.

Significant performance characteristics are summarized in Table II.

TABLE II

| | % | | | Process Cycle | | |
|---|---|---|---|---|---|---|
| Element | X-Over | MSC | LSC | 55" | 40" | 30" |
| A | NA* | 3.2 | 2.3 | >100% | >100% | >100% |
| B | 6 | 3.5 | 2.3 | <50% | 60% | 70% |
| C | 6 | 2.7 | 2.0 | <50% | 60% | 70% |
| D | 9 | 2.5 | 1.9 | <50% | 60% | 70% |

*not applicable

All of the elements exhibited essentially similar speeds (differing by <0.05 log E) measured at a density of 1.0 above minimum density. The fact that the rhodium dopant in Element B was able to increase contrast without lowering speed was surprising.

All of the elements produced maximum densities of greater than 3.6. All of the elements were satisfactorily processed using the extended (120") and standard (82") processing cycles.

Only Element B, satisfying the requirements of the invention, and conventional mammographic film Element A were capable of producing a mid-scale contrast (MSC) of greater than 3.0 and a lower scale contrast (LSC) of greater than 2.2, as required for acceptable quality mammographic imaging. From Elements C and D it is apparent that a combination of tabular grains having low grain size dispersity COV and rhodium doping was required to achieve this performance capability.

Only Element B, satisfying the requirements of the invention, was capable of both satisfying mammographic imaging requirements and undergoing overall processing in the lower processing times that are now supplanting the Standard processing cycle.

Despite the reduced levels of gelatin in the dual-coated radiographic elements, which permitted accelerated processing times, there was no evidence of wet pressure sensitivity in the dual-coated films. This is attributed to distributing the silver halide grains between the overlying and underlying emulsion layers. Viewed another way, a portion of the silver halide that Dickerson et al U.S. Pat. No. 4,900,652 placed entirely in a single emulsion layer overlying the particulate dye containing crossover control layer was transferred to the crossover control layer to allow lower hydrophilic colloid coating coverages without incurring wet pressure sensitivity.

The invention has been described in detail with particular reference to preferred embodiments thereof, but it will be understood that variations and modifications can be effected within the spirit and scope of the invention.

What is claimed is:

1. A medical diagnostic radiographic element comprised of a film support having first and second major surfaces capable of transmitting radiation to which the radiographic element is responsive and, coated on each of the major surfaces, processing solution permeable hydrophilic colloid layers which are fully forehardened including at least one emulsion comprised of silver halide grains, a spectral sensitizing dye adsorbed by the silver halide grains, and a particulate dye (a) capable of absorbing radiation to which the silver halide grains are responsive, (b) present in an amount sufficient to reduce crossover to less than 15 percent, and (c) capable of being substantially decolorized during processing, WHEREIN, to facilitate mammographic imaging as well as rapid processing with low wet pressure sensitivity, said silver halide grains are coated at a coverage capable of providing an overall radiographic element maximum density on processing of greater than 3.6, less than 35 mg/dm$^2$ of hydrophilic colloid is coated on each of the major surfaces of the support, first and second of the hydrophilic colloid layers each containing a tabular grain emulsion are coated on each major surface of the support with the first layers located nearer the support than the second layers, the second layers contain (a) silver halide grains accounting for from 30 to 70 percent of the total weight of the second layers and accounting for greater than 50 percent of total grain projected area within the second layers, and (b) from 20 to 80 percent of the total silver forming the silver halide grains within the radiographic element, the first layers contain (a) the dye particles and (b) from 20 to 80 percent of the total silver forming the silver halide grains within the radiographic element, the dye particles and the silver halide grains together account for from 30 to 70 percent of the total weight of each of the first layers, and radiation-sensitive silver halide grains within the first and second hydrophilic colloid layers exhibit a coefficient of variation of grain equivalent circular diameter of less than 15 percent and contain rhodium in a normalized molar concentration of less than $1\times10^{-7}$ based on silver to provide a mid-scale contrast of greater than 3.0 and a lower scale contrast of greater than 2.2, where mid-scale contrast is the slope of a line drawn between characteristic curve points at densities of 0.25 and 2.0 above minimum density and lower scale contrast is the slope of a line drawn between a first reference point on the characteristic curve at a density of 0.85 above minimum density and a second, lower exposure reference point on the characteristic curve separated from the first reference by an exposure difference of 0.3 log E, where log E is the log of exposure in lux-seconds.

2. A mammographic imaging radiographic element according to claim 1 wherein said radiation-sensitive silver halide grains within said first and second hydrophilic colloid layers exhibit a coefficient of variation of less than 10 percent.

3. A mammographic imaging radiographic element according to claim 1 wherein the rhodium dopant is present in a normalized molar concentration greater than $1\times10^{-9}$ based on silver.

4. A mammographic imaging radiographic element according to claim 3 wherein the rhodium dopant is present in a normalized molar concentration in the range of from $5\times10^{-9}$ to $1\times10^{-8}$ based on silver.

5. A mammographic imaging radiographic element according to claim 1 wherein the particulate dye is present as particles capable of reducing crossover to less than 10 percent.

6. A mammographic imaging radiographic element according to claim 1 wherein said first and second hydrophilic colloid layers each contain tabular grains having an average thickness of at least 0.1 $\mu$m.

7. A mammographic imaging radiographic element according to claim 1 wherein said first and second hydrophilic colloid layers each contain tabular grains having a thickness of less than 0.2 $\mu$m and accounting for at least 70 percent of total grain projected area.

8. A mammographic imaging radiographic element according to claim 1 wherein the radiographic element can be processed by the following processing cycle:

| | |
|---|---|
| development | 15.1 seconds |
| fixing | 12.9 seconds |
| washing | 10.4 seconds |
| drying | 16.6 seconds |

employing a hydroquinone-pyrazolidinone developer.

* * * * *